US006000355A

United States Patent [19]

Hall

[11] Patent Number: 6,000,355

[45] Date of Patent: Dec. 14, 1999

[54] STABILIZED WATERCRAFT

[76] Inventor: Thomas R. Hall, 144 Faithway Dr., Walland, Tenn. 37886

[21] Appl. No.: 09/122,976

[22] Filed: Jul. 27, 1998

[51] Int. Cl.[6] ..... B63B 43/41; B63B 35/00; B63B 11/113

[52] U.S. Cl. ..... 114/123; 114/347; 440/42

[58] Field of Search ..... 114/123, 347, 114/352, 353, 354, 61, 283; 440/40, 42, 43

[56] References Cited

U.S. PATENT DOCUMENTS

| | | | |
|---|---|---|---|
| 1,132,924 | 3/1915 | Gepack | 113/123 |
| 3,302,605 | 2/1967 | Kuether | 440/43 |
| 3,702,106 | 11/1972 | Wilder | 115/70 |
| 4,172,426 | 10/1979 | Susman . | |
| 4,213,412 | 7/1980 | Jamieson . | |
| 4,286,533 | 9/1981 | Sanner . | |
| 4,465,008 | 8/1984 | Liggett . | |
| 4,512,275 | 4/1985 | Drumm . | |
| 4,562,785 | 1/1986 | Priam-Doizi . | |
| 4,664,049 | 5/1987 | Mourgue et al. . | |
| 4,730,570 | 3/1988 | Harris . | |
| 4,771,716 | 9/1988 | Dat . | |
| 4,964,357 | 10/1990 | Genfan . | |
| 5,050,517 | 9/1991 | Kobayashi . | |
| 5,174,233 | 12/1992 | Nielson . | |
| 5,215,482 | 6/1993 | Henry . | |
| 5,481,997 | 1/1996 | Arndt | 114/347 |
| 5,515,801 | 5/1996 | Fortin et al. . | |
| 5,642,682 | 7/1997 | Pierce . | |
| 5,647,294 | 7/1997 | Finley . | |
| 5,682,831 | 11/1997 | Yokoi . | |

*Primary Examiner*—Sherman Basinger
*Assistant Examiner*—Patrick Muldoon
*Attorney, Agent, or Firm*—Pitts & Brittian, P.C.

[57] ABSTRACT

A watercraft including an elongated V-type hull and first and second stabilizers mounted in outrigger fashion on opposite sides of the hull. In a preferred embodiment, each stabilizer includes an elongated flotation member having its longitudinal centerline aligned with the longitudinal centerline of the hull. Each stabilizer is retractably mounted on its respective side of the hull employing a pantographic-type set of extensors interconnecting its flotation member with the hull, whereby each flotation member, and its accompanying extensor arms, may be independently extended away from the hull or retracted to a position alongside the hull.

5 Claims, 6 Drawing Sheets

STABILIZED WATERCRAFT

TECHNICAL FIELD

This invention relates to watercraft and more particularly watercraft having stabilizing outriggers.

BACKGROUND ART

In the field of boating it is well known that stability is an important issue. On open waterways where winds and the wakes of boats can cause the water to be choppy, boats need stability in order to give a comfortable ride and prevent the boat from capsizing. In the industry, a large number of boats made at present are single hulled models that have a width large enough to give a boat the stability it needs to navigate in the choppy conditions common to oceans and lakes. The industry also currently includes many boats which are known as multi-hulled boats and which usually consist of a platform with two independent, pontoon shaped hulls on opposite sides of this platform for support of passengers and navigating equipment. Both of these types of boats have sufficient width to sustain stability in the water under normal conditions of use, however, their respective widths make them difficult, and costly, to transport and store. The hull sizes for these watercrafts also tend to increase their costs of manufacture, hence greater costs to the consumer.

Boats having relatively narrow hulls and including features to enhance stability have heretofore been known. Typical art related to such boats is shown in U.S. Pat. Nos. 4,964,357; 5,647,294; 5,682,831; 5,642,682; 5,515,801; 4,771,716; 4,664,049; 4,512,275; 4,562,785; 4,730,570; and 5,174,233. Boats having narrow canoe-shaped hulls are particularly unstable in choppy water; however, such boats are normally relatively easy to transport and relatively light in weight. Rigid laterally-mounted stabilizers for watercraft are known in the art, but such rigs are difficult to transport over land and to store when not in use.

In certain light-weight and relatively small watercraft, it has become common in the industry to power the watercraft employing a stream of water jetted from a movable nozzle, ie., jet ski-type watercraft, etc. Movement of the directionality of the nozzle, hence the direction of thrust of the jet stream of water, functions to propel the craft and to steer the craft. These watercraft suffer from potentially disastrous loss of steerability when the water jet is lost, either intentionally by shutting down the motor, or upon inadvertent loss of power when the craft is underway.

Accordingly it is an object of the present invention to provide a watercraft having stabilizers which are selectively extensible and retractable relative to the hull of the watercraft.

Another object of the invention is to provide a motorized stabilized watercraft having a relatively narrow elongated hull.

Another object of the invention is to provide a watercraft having selectively adjustable elongated flotation members which provide lateral (side to side) stability while at the same time providing longitudinal (fore to aft) stability.

It is another object of the present invention to provide a stabilized motor-powered watercraft which is steerable when the propulsion motor is deactivated while the craft is underway.

BRIEF DESCRIPTION OF DRAWINGS

The above mentioned, and other, features and advantages of the invention will become more clearly understood from the following detailed description of the invention read together with the claims and drawings in which:

SUMMARY OF INVENTION

In accordance with one aspect of the present invention, there is provided a watercraft including an elongated V-type hull and first and second stabilizers mounted in outrigger fashion on opposite sides of the hull. In a preferred embodiment, each stabilizer includes an elongated flotation member having its longitudinal centerline aligned with the longitudinal centerline of the hull. Each stabilizer is retractably mounted on its respective side of the hull employing a pantographic-type set of extensors interconnecting its flotation member with the hull, whereby each flotation member, and its accompanying extensor arms, may be independently extended away from the hull or retracted to a position adjacent to and alongside the hull.

In accordance with another aspect of the present invention, the hull of the watercraft is provided with a motor for powering the craft over the water, preferably a conventional jet-type propulsion system which includes a movable nozzle disposed on the underside of the hull. Further, in this embodiment, the nozzle is provided with a rudder which depends from the nozzle into the water and which is movable as the nozzle moves. By this means, even though no jet stream of water is flowing from the nozzle, movement of the nozzle functions to adjust the position of the rudder and thereby effect steering of the watercraft so long as the craft is moving through the water, as when coasting after inadvertent shut down of the motor.

DETAILED DESCRIPTION OF INVENTION

Figure 1:
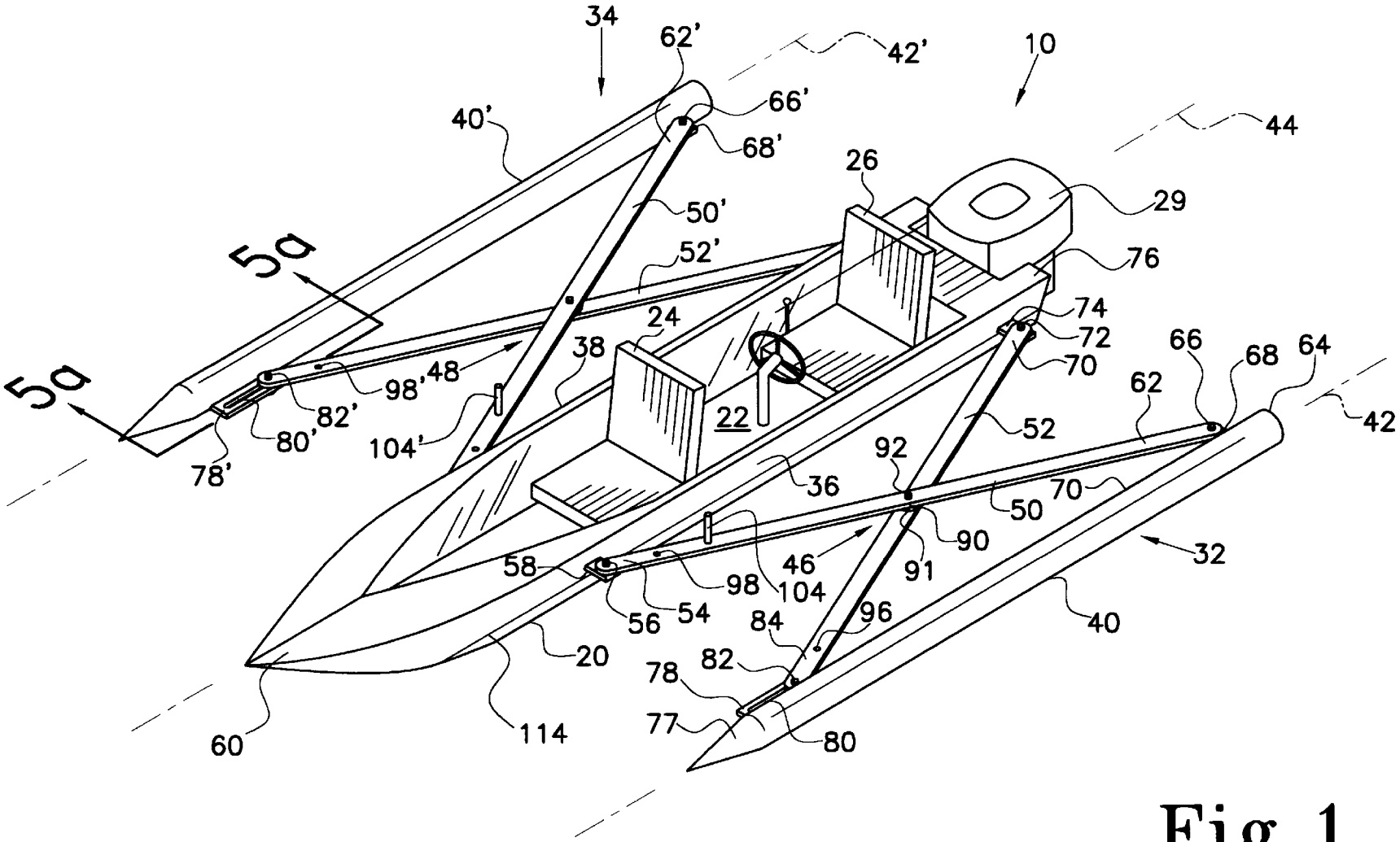
FIG. 1 is a perspective view of one embodiment of a stabilized watercraft constructed in accordance with various features of the present invention and depicting outrigger-type stabilizers thereon and in their extended and locked positions.

One embodiment of a stabilized watercraft constructed in accordance with the present invention is illustrated generally at 10 in the Figures. The stabilized watercraft 10 includes an elongated shallow V-type central hull 20. In a preferred embodiment, the hull preferably is constructed of a strong, yet lightweight material such as fiberglas. Accordingly, the craft is readily handled by a single person for storing, loading and offloading the craft from a trailer, and maneuvering when in the water. In the embodiment depicted in the several Figures, the hull 20 includes a passenger compartment 22 housing one or more passenger seats 24 and 26. The aft end 28 of the hull further serves to house a conventional propulsion system 27 partially depicted in FIG. 7, preferably including a moveable nozzle 30 (See FIG. 7) through which a stream of water is jetted to provide forward propulsion of the hull through the water. As is well known in the industry, the nozzle is moveable from side to side to redirect the stream of water jetted therefrom when the motor of the propulsion system is operating, to thereby steer the craft to the left or to the right. Alternatively, the watercraft may be propelled by a conventional outboard motor 27 as depicted in FIG. 1.

Stabilization of the lightweight elongated hull is effected in accordance with one aspect of the present invention by means of first and second stabilizers 32 and 34, one 32 of which is disposed on a first side 36 of the hull and the other 34 of which is disposed on a second side 38 of the hull. As depicted, each stabilizer comprises an elongated flotation member 40, 40' having its longitudinal centerline 42 oriented substantially parallel to the longitudinal centerline 44 of the hull. In a preferred embodiment, each flotation member is of a length approximately equal to about ⅔ the length of the hull and may comprise a hollow watertight tubular member or may be filled with a flotation material such as a polymeric foam 111 (See FIG. 5*b*).

Each flotation member 40 is mounted in outrigger fashion to its respective side of the hull as by means of a set 46,48 of first and second extensor arms 50 and 52. One end 54 of the first extensor arm 50 of a first set of extensor arms 46 is pivotally mounted by a readily movable pivot pin 56 to a bracket 58 which projects from the side 36 of the hull at a location adjacent the bow 60 of the hull. This extensor arm 50 extends from its pivotal mounting adjacent the bow of the hull and terminates at its opposite end 62 adjacent the aft end 64 of the flotation member 40 where it is pivotally anchored by a pivot pin 66 to a bracket 68 which projects from the side 70 of the flotation member 40 toward the hull. One end 70 of the second extensor arm 52 of the first set of extensor arms 46 is pivotally anchored by a pivot pin 72 to a bracket 74 which projects from the side 36 of the hull at a location adjacent its aft end 76 and extends therefrom to a location adjacent the bow end 77 of the flotation member. At this location on the flotation member there is provided a bracket 78 which projects from the side 70 of the flotation member 40 in a direction toward the hull and includes an elongated slot 80. A pivot pin 82 is provided through the end 84 of the extensor arm and through the slot 80 to anchor the end of the second extensor arm to the flotation member. It will be recognized that the pivot pin 82 is slidable within and along the length of the slot 80.

Figure 2:
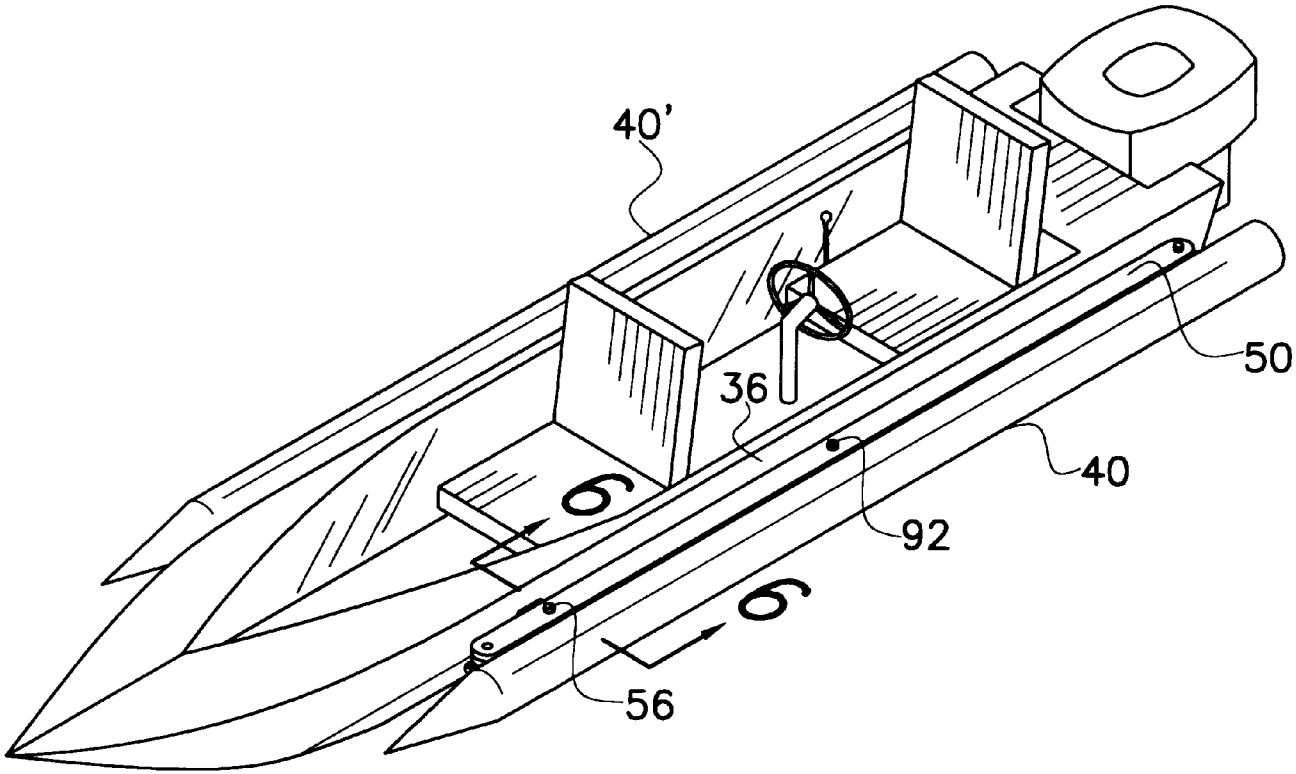
FIG. 2 is a perspective view of the watercraft of FIG. 1 and having the stabilizers in their stored positions adjacent to and alongside the watercraft hull.
Figure 3:
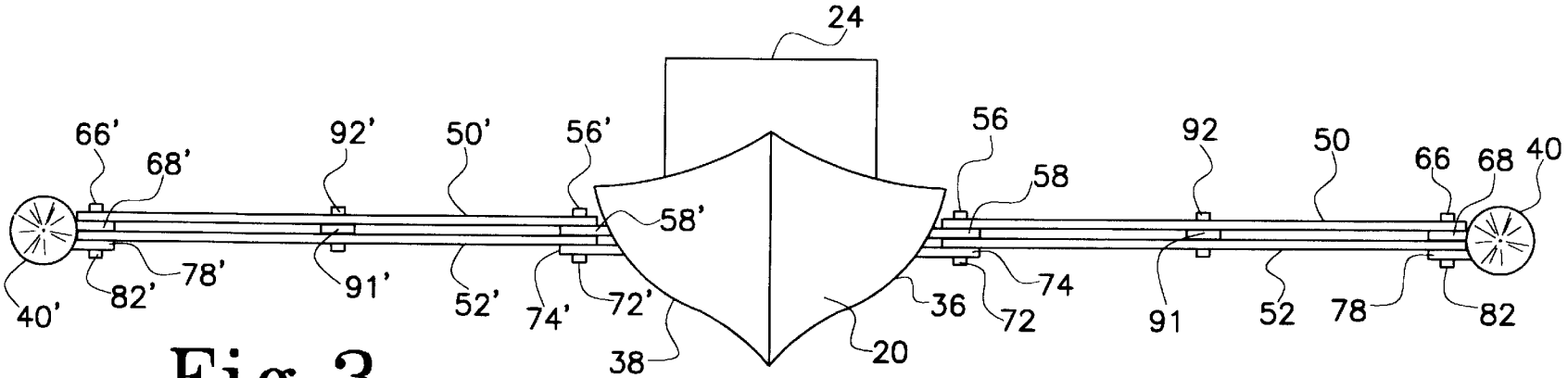
FIG. 3 is a front elevation view of the watercraft depicted in FIG. 1.

The first and second extensor arms 50,52 of each set of extensor arms cross one another at their respective midpoints 90 along their respective lengths. At this crossing location, the arms are pivotally connected as by a pivot pin 92. As desired, a washer 91 may be interposed between the extensor arms at their crossing location. As thus mounted between the flotation member 40 and the hull 20, the extensor arms 50,52 define a type of pantographic mounting of the flotation member 40 with respect to the hull so that upon collapsing of the stabilizer 32, the flotation member and its extensor arms may be moved laterally toward the hull to a position wherein the extensor arms and the flotation member are disposed in alignment with the hull and immediately adjacent to and alongside the side 36 of the hull as depicted in FIG. 2. Conversely, upon extension of the stabilizer 32, the flotation member 40 is moved to a position spaced apart from the hull and thereby in position to stabilize the hull against rotation about its longitudinal centerline. By reason of its length and mounting to the hull, the flotation member further provides foreto aft stabilization of the hull. Further, even when disposed adjacent to and alongside the hull, the flotation members are fixed relative to the hull and thereby provide stabilization to the hull.

To accommodate the collapsing of the stabilizer against the side of the hull, the present inventor provides a length for the slot 80 which is sufficient to permit the pivot pin 82 at the end 84 of the second extensor arm 52 to slide within the slot a distance adequate to accommodate the effective shortening of the extensor arm 52 as the stabilizer is collapsed toward the hull. In this connection, the present inventor, further provides a readily removable pivot pin 56 for anchoring the end 54 of the first extensor arm 56 to the bracket adjacent the bow of the hull. When it is desired to collapse the stabilizer, the pivot pin 56 is removed, thereby freeing the end 54 of the extensor arm 50 to move in a direction toward the bow of the hull and permit the extensor arm 50 to be moved into aligned position alongside the side of the hull. Further, as the stabilizer is moved from its extended toward its collapsed position, the pivot pin 82 slides along and within the slot 80 in the bracket 78 to accommodate the effective shortening of the extensor arm 50. Notably, this mounting arrangement permits ready collapse of the stabilizer by a person positioned within the hull. Likewise, a person positioned within the hull can readily extend the stabilizer to its fully extended position as shown in FIG. 1.

Figure 6:
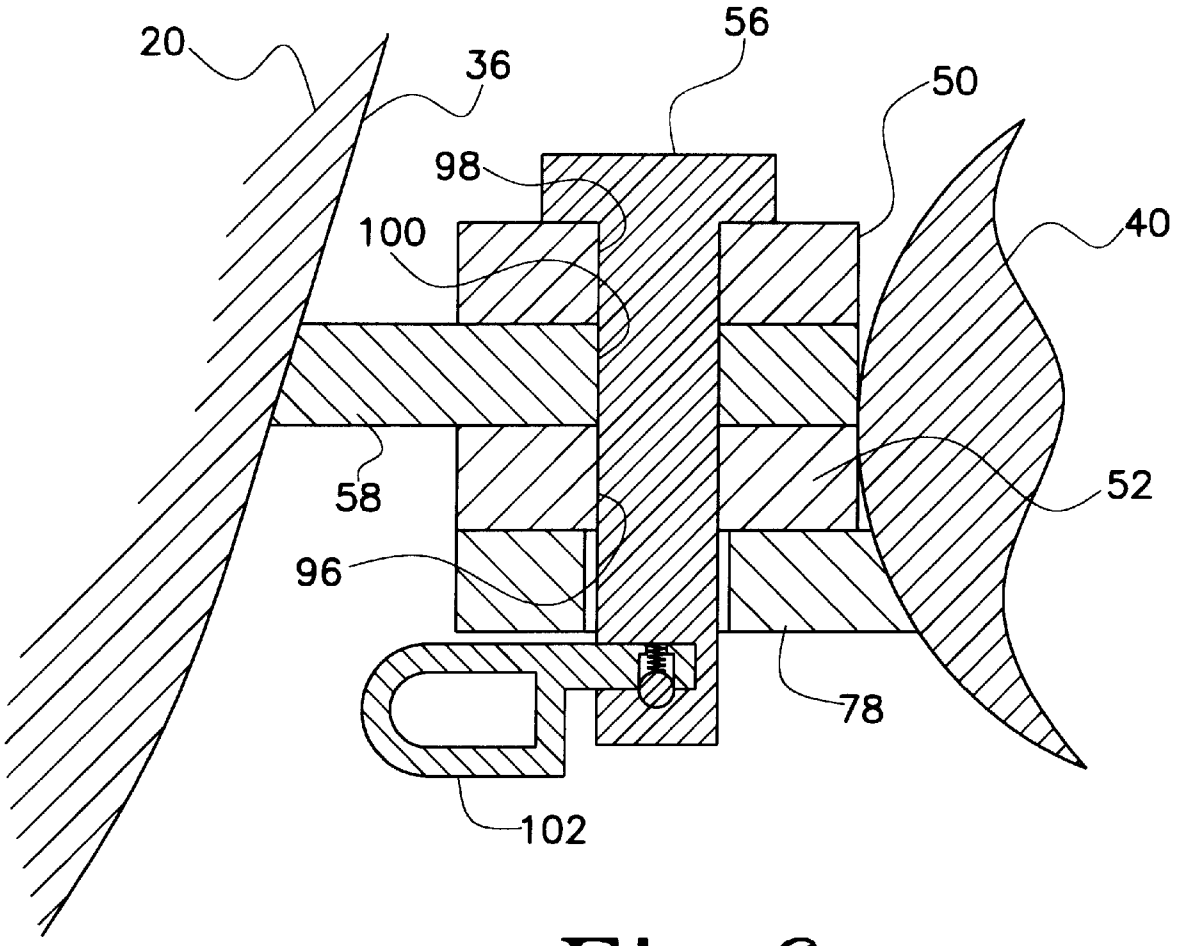
FIG. 6 is a sectional view taken generally along the line 6—6 in FIG. 2 and depicting of one embodiment of a locking means for a stabilizer in the stored position.

Referring specifically to FIGS. 1, 2 and 6, for securing each of the collapsed flotation members and their respective extensor arms in the desired position adjacent to and alongside the hull, for example, the end 54 of the first extensor arm 50 and the end 84 of the second extensor arm 52 are each provided with a throughbore 96 and 98 respectively, at a location spaced inwardly from their respective ends such that when these arms in their collapsed state are adjacent to and alongside the hull, these throughbores 96 and 98 are in register with each other and also in register with the throughbore in the bracket 58 on the bow end of the hull. The removable pivot pin 56 can then be inserted in these registered throughbores and thereby secure the flotation member and its extensor arms in their collapsed positions adjacent to and alongside the side of the hull. As desired, the pivot pin 56 may be provided with a locking pin 102. In one embodiment of the present invention, each of the extensor arms 50 and 50' is provided with a handle member 104 and 104', respectively, at a location adjacent the bow end of each of the extensor arms 50 and 50'. Thus, the handle members are in position for grasping by a passenger in the hull and applying a force to the extensor arm sufficient to move the stabilizer between its extended and collapsed positions without exiting the hull. Notably, this ability is afforded by reason of the multipoint pivotal interconnection of the extensor arms and the hull and the flotation member.

In a preferred embodiment, each of the brackets employed to mount the ends of the extensor arms to a side of the hull are located above the waterline 114 of the craft so that these brackets are out of the water at least when the craft is either floating idley in the water or moving slowly through the water. In this respect, the brackets employed for mounting the extensor arms to the flotation members are disposed preferably at or above the horizontal midplane of their respective flotation device so that each flotation device rides in the water when the craft is sitting idle or moving slowly through the water.

In accordance with one feature of the present invention, the inventor locates the stabilizers nearer the aft end of the hull. Specifically, the aft end of each extensor arm is mounted relatively near, e.g., within about eighteen inches or less, the aft end of the hull, and the bow end of each extensor arm which is mounted adjacent the bow end of the hull is located rearwardly from the bow end of the hull by about ⅓ the length of the hull, thereby positioning the stabilizer flotation members within about the rear (aft) two-thirds of the hull length. This factor, in combination with the weight of a motor mounted on the aft end of the hull, plus the weight of a passenger in the aft seat 28 of the craft, causes the aft end of the craft to sit slightly lower in the water than the bow end of the craft. When the motor is activated to propel the craft forwardly through the water, this action tends to further lower the aft end of the craft into the water and to raise the bow end of the craft somewhat out of the water. Simultaneously, these factors tend to raise the bow ends of the flotation members partially or completely out of the water, depending upon the overall distribution of weight of the hull, motor, passenger(s) and/or cargo. In any event, once the craft has "planed", the aft end of the craft raises in the water, bringing the hull to a near horizontal attitude. By reason of the placement of the mounting locations of the ends of the extensor arms on the flotation devices and on the sides of the hull above the normal waterline of the hull, once the craft "planes", the flotation devices may be caused to ride slightly out of and above the surface of the body of water, leaving only the bottom portion of the hull in the water. Under these conditions, the speed of the craft is not hindered by drag from the flotation members and the craft can be operated at relatively high speeds. After the speed of the craft has been reduced, the flotation members settle into the water and stabilize the craft.

In accordance with a further aspect of the present invention, the pantographic-type mounting of each flotation member to the hull assures that, as the stabilizer is extended or retracted, the flotation member is held in alignment with the hull. In that manner, it is assured that the flotation member does not skew and bind when being extended or retracted, such as may require a passenger to enter the water to aid in extending or retracting the stabilizer.

Whereas only one stabilizer has been described herein in detail for purposes of clarity, it will be noted that a preferred embodiment of the present invention includes a stabilizer on each of the opposite sides of the hull. In the depicted embodiment, the second stabilizer is essentially a mirror image of the first stabilizer and functions in like manner are the first stabilizer. Prime numerals associated with the second stabilizer 34 indicate like components of the first stabilizer 32. As noted, when the flotation members are in their extended positions relative to the hull, the hull is stabilized both laterally (against rotation about its longitudinal centerline) and fore to aft. Further, the use of stabilizer on opposite sides of the hull assures against overturning of the hull, such as when a swimmer climbs out of the water and into the hull, and other circumstances where the center of gravity of the hull is unbalanced to one side of the hull.

For storage of the stabilized watercraft, including loading onto a transport trailer, the flotation members are collapsed and locked into their positions adjacent and alongside the hull. This action reduces the effective width of the stabilized watercraft such that the craft consumes less lateral space and is not cumbersome to handle when on land.

Figure 4:
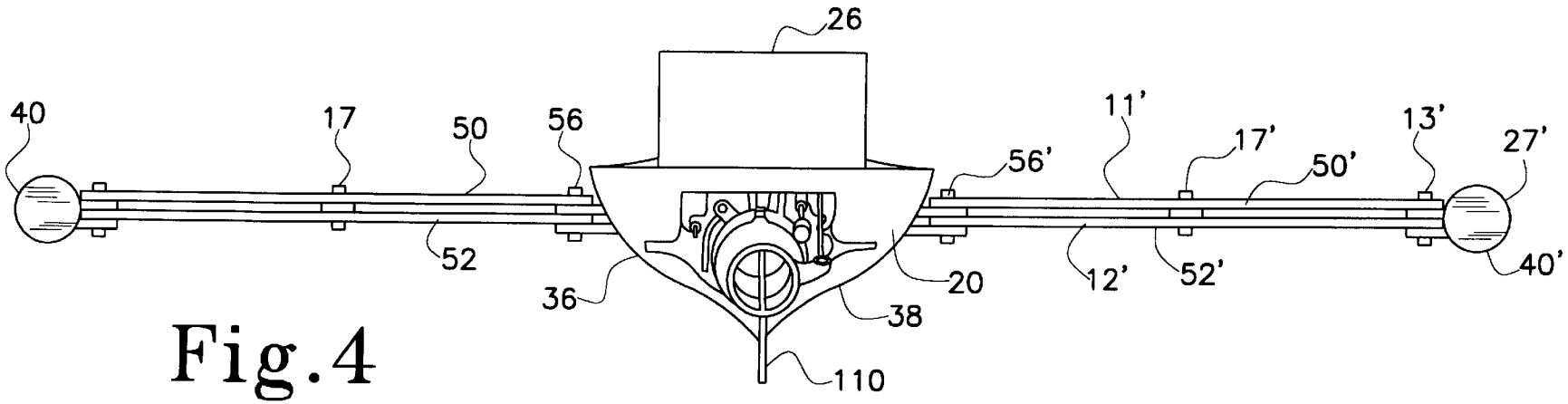
FIG. 4 is a rear elevation view of the watercraft depicted in FIG. 1.
Figure 7:
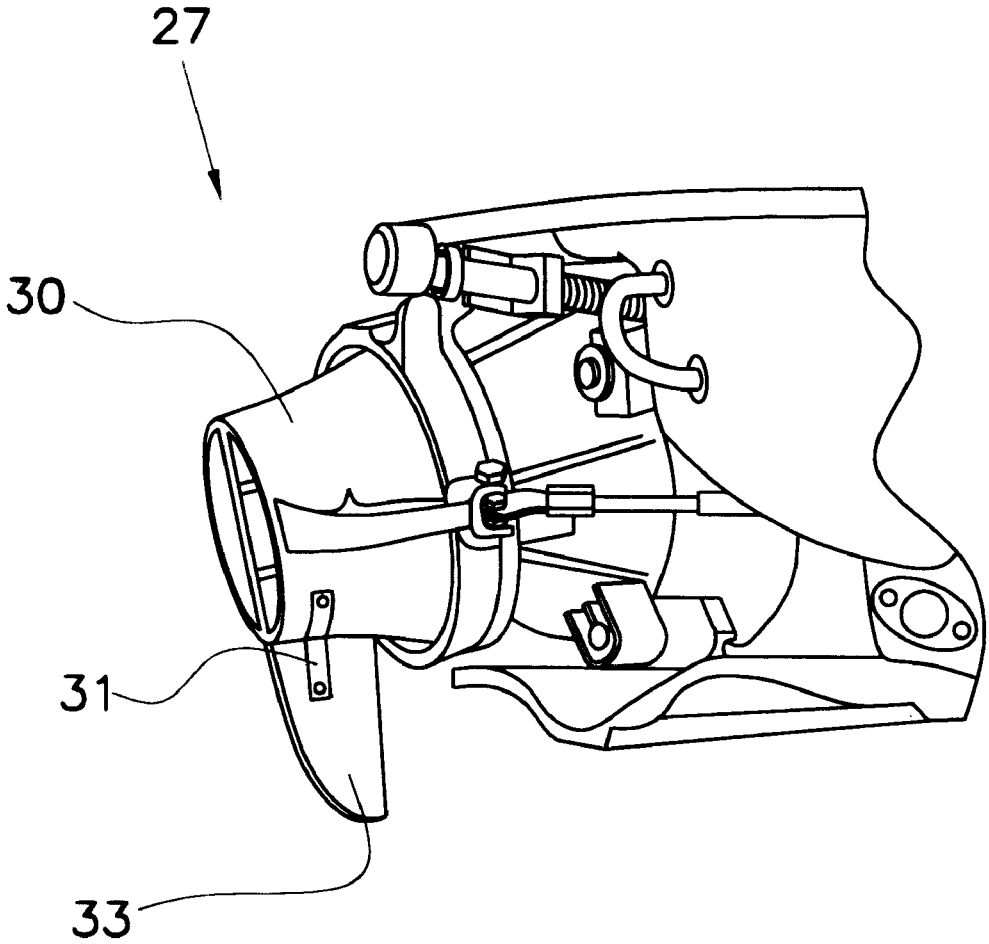
FIG. 7 is a partial elevation view of one embodiment of a the aft end of a watercraft and depicting a portion of a propulsion system for the watercraft, and including a rudder operatively mounted on a movable nozzle element of the propulsion system.

In accordance with another feature of one embodiment of the present invention, the stabilized watercraft is provided with means for steering the craft when the propulsion system thereof is inactivated. With reference to FIGS. 4 and 7, there is depicted a nozzle element 30 of a water jet propulsion system of conventional design. Water propelled outwardly through this nozzle serves to propel the craft through the water. Movement of the nozzle, hence the direction of its water jet, from side to side also serves to provide steering of the craft. Such movement of the nozzle is commonly effected by means of a steering wheel disposed within the passenger compartment of the hull. This movement of the nozzle is not dependent upon the propulsion system being active. As noted, when the propulsion system is inactive, for whatever reason, and the craft is continuing to move through the water, there is no waterjet emanating from the nozzle for steering of the craft. The present inventor resolves this steering problem by providing a rudder 110 which depends from the nozzle and is movable with the nozzle as the nozzle is moved by the steering wheel. Thus, this rudder is available both to enhance the steering of the craft when the propulsion system is active and to provide for steering of the coasting craft when the propulsion system is inactivated. This feature of the invention is particularly beneficial when beaching the craft or when pulling alongside another watercraft or a dock. In the depicted embodiment, the rudder is retrofitted to an existing nozzle as by means of one or more rigid brackets 31 affixed to the rudder and to the outer surface of the rudder. As desired, the rudder may be formed integrally with the nozzle.

Figure 5A:
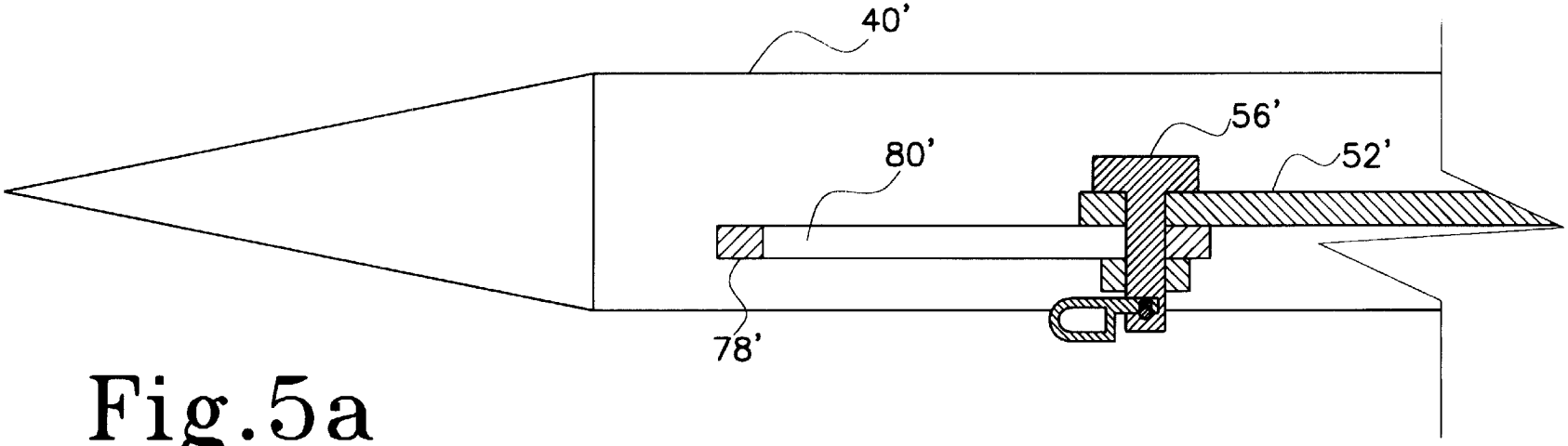
FIG. 5*a* is a partial side elevation view taken generally along the line 5*a*—5*a* of FIG. 1.
Figure 5B:
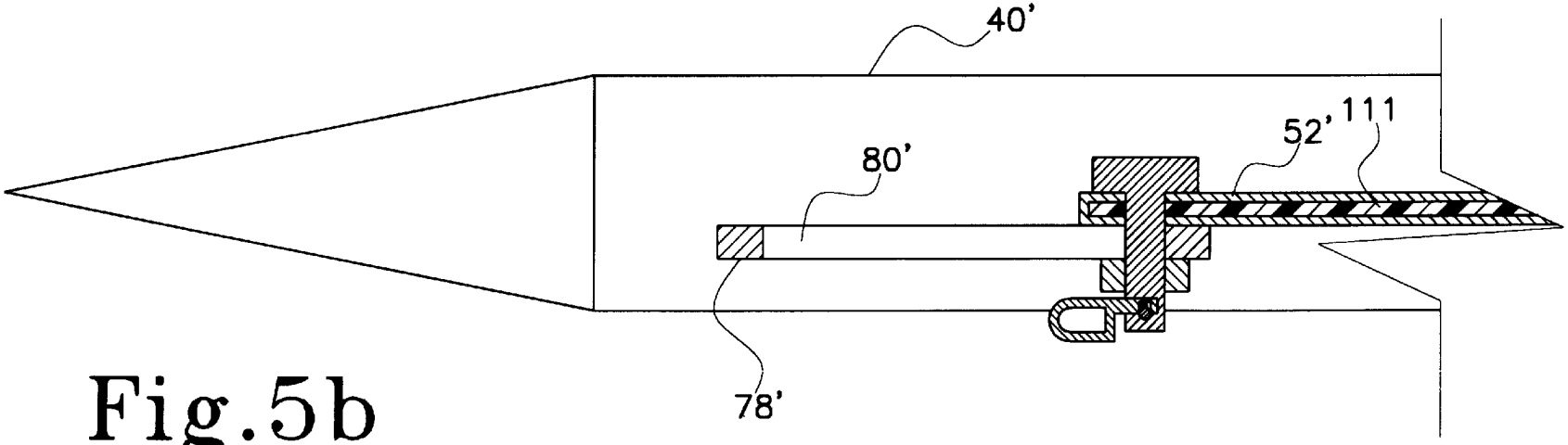
FIG. 5*b* is a partial side elevation view of an alternate embodiment, partly in section, of a stabilizer mounted on a watercraft of the type depicted in FIG. 3.

In one embodiment of the present invention a fiberglass hull of about 12 feet long and about 24 inches wide at its widest point along the length of the hull, is provided with first and second stabilizers 32, 34, each of which includes an elongated hollow tubular flotation member of about four inches diameter and between about 10 and about 12 feet in length. In this embodiment, each of the extensor arms is between about 10 and 11 feet long, thereby providing for extension of the flotation members a distance of between about 3 and about 4 feet from each side of the hull. The preferred flotation member is of a straight cylindrical geometry except its bow end is tapered to enhance its movement through waves or choppy water. The flotation member may be fabricated of fiberglass, light-weight sheet metal or aluminum sheet. The extensor arms may be solid members, but preferably are tubular and fabricated from a strong lightweight metal alloy. In one embodiment, as depicted in FIG. 5*b*, the extensor arms and/or the flotation members may be filled with a flotation material, such as a polymeric foam 111.

Whereas the present invention has, at times herein, been described in specific terms, dimensions, etc., it is to be understood that one skilled in the art will recognize acceptable equivalents and the invention is to be limited only as set forth in the claims attached hereto. For example, whereas the present invention has been described as including a slotted bracket for mounting of one end of an extensor arm at a location adjacent the bow end of a flotation member and having a readily removable pivot pin anchoring one end of an extensor arm to the hull at a location adjacent the bow end of the hull, it will be recognized that these mounting locations may be located at the aft end of the flotation member and the aft end of the hull without altering the scope of the present invention. Further, given the present disclosure, one skilled in the art will recognize other like or similar apparatus and means for anchoring of the ends of the extensor arms to the hull and to the flotation member and which preserve the pantographic-type extensibility and retractability of the flotation members away from and toward the sides of the hull. In like manner, one skilled in the art will recognize various equivalent means for locking the stabilizers in their extended or retracted positions. In any event, it is preferred that when extended, each flotation member is aligned with its longitudinal centerline substantially parallel to the longitudinal centerline of the hull and that this alignment be maintained when the flotation member is positioned adjacent to and alongside the side of the hull.

What is claimed:

1. A stabilized watercraft comprising an elongated hull having first and second opposite sides, first and second opposite ends, and a longitudinal centerline, first and second stabilizers mounted in outrigger fashion on opposite sides of said hull, each stabilizer including an elongated flotation member having first and second opposite ends and a longitudinal centerline substantially aligned with the longitudinal centerline of said hull, and first and second sets of extensor arms interconnecting respective ones of said flotation members to respective sides of said hull, each of said sets of extensor arms including first and second extensor arms, each extensor arm having first and second opposite ends, said first end of said first extensor arm of said first set of extensor arms being pivotally mounted on said first side of said hull adjacent said first end of said hull, said second end of said first extensor arm of said first set of extensor arms being mounted to said first flotation member adjacent said first end of said flotation member for movement of said second end of said first extensor arm of said first set of extensor arms in a direction generally parallel to the longitudinal centerline of said first flotation member upon the movement of said first flotation member toward and away from said hull, said first end of said second extensor arm of said first set of extensor arms being releasably mounted to said first side of said hull adjacent said second end of said hull, said second end of said second extensor arm of said first set of extensor arms being pivotally mounted to said first flotation member adjacent said second end of said first flotation member, said first and second extensor arms of said first set of extensor arms crossing one another at a location intermediate their respective first and second ends, means for pivotally connecting said first and second extensor arms of said first set of extensor arms at the location of their crossing, said first end of said first arm of said second set of extensor arms being pivotally mounted on said second side of said hull adjacent said first end of said hull, said second end of said first extensor arm of said second set of extensor arms being mounted to said second flotation member adjacent said first end of said flotation member for movement of said second end of said first extensor arm of said second sets of extensor arms in a direction generally parallel to the longitudinal centerline of said second flotation member upon the movement of said second flotation member toward and away from said hull, said first end of said second extensor arm of said second set of extensor arms being releasably mounted to said second side of said hull adjacent said second end of said hull, said second end of said second extensor arm of said second set of extensor arms being pivotally mounted to said second flotation member adjacent said second end of said flotation member, said first and second extensor arms of said second set of extensor arms crossing one another at a location intermediate their respective first and second ends, means for pivotally connecting said first and second extensor arms of said second set of extensor arms at the location of their crossing, whereby, from a location within said hull, said first flotation member is selectively positionable between a location spaced apart from said first side of said hull and a location adjacent to and alongside said first side of said hull when said first end of said second extensor arm of said first set of extensor arms is released from its mounting to said first side of said hull, and said second flotation member is selectively positionable between a location spaced apart from said second side of said hull and a location adjacent to and alongside said second side of said hull when said first end of said second extensor arm of said second set of extensor arms is released from its mounting to said first side of said hull.

2. The stabilized watercraft of claim 1 and including a handle associated with each of said first and second sets of extensor arms at a location thereon whereby said handle on each set of extensor arms is readily grasped from a location within said hull for moving said flotation members between their respective extended and retracted positions relative to said hull.

3. The stabilized watercraft of claim 1 wherein said second end of said first extensor arm of said first set of extensor arms and said second end of said first extensor arm of said second set of extensor arms are slidably mounted with respect to their respective flotation member.

4. The stabilized watercraft of claim 1 and including a jet-type propulsion system for propelling said watercraft over the surface of a body of water.

5. The stabilized watercraft of claim 4 wherein said propulsion system includes a moveable nozzle, a rudder depending from said nozzle, and means located within said hull for effecting movement of said nozzle.

* * * * *